US007167140B2

(12) United States Patent
Kato et al.

(10) Patent No.: US 7,167,140 B2
(45) **Date of Patent: *Jan. 23, 2007**

(54) COIL ANTENNA

(75) Inventors: Yoshihiko Kato, Sendai (JP); Naoharu Yamamoto, Sendai (JP); Makoto Teshima, Sendai (JP)

(73) Assignee: NEC Tokin Corporation, Sendai (JP)

( * ) Notice: Subject to any disclaimer, the term of this patent is extended or adjusted under 35 U.S.C. 154(b) by 40 days.

This patent is subject to a terminal disclaimer.

(21) Appl. No.: 10/883,083

(22) Filed: Jul. 1, 2004

(65) Prior Publication Data

US 2005/0024285 A1 Feb. 3, 2005

(30) Foreign Application Priority Data

Jul. 2, 2003 (JP) ..... 2003-270331

(51) Int. Cl.
*H01Q 7/08* (2006.01)

(52) U.S. Cl. ..... 343/788

(58) Field of Classification Search ..... 343/788
See application file for complete search history.

(56) References Cited

U.S. PATENT DOCUMENTS 3,777,295 A * 12/1973 Laing ..... 335/297
3,778,836 A 12/1973 Tanaka ..... 343/702
3,905,841 A * 9/1975 Simonetti ..... 148/105
4,755,823 A * 7/1988 Ohe et al. ..... 343/713
4,947,179 A * 8/1990 Ganter et al. ..... 343/718
4,978,966 A * 12/1990 Takizawa et al. ..... 343/788
5,136,303 A 8/1992 Chuo et al. ..... 343/718
5,220,338 A * 6/1993 Matsushita ..... 343/787
5,319,364 A * 6/1994 Waraksa et al. ..... 340/5.64
5,396,698 A * 3/1995 Orthmann et al. ..... 29/600
5,408,243 A * 4/1995 D'Hont ..... 343/718
5,430,693 A * 7/1995 Ganter et al. ..... 368/47
5,567,537 A * 10/1996 Yoshizawa et al. ..... 428/800
5,625,366 A * 4/1997 D'Hont ..... 343/718
6,018,298 A 1/2000 Endo et al. ..... 340/572.5
6,134,188 A * 10/2000 Ganter et al. ..... 368/47
6,229,444 B1 5/2001 Endo et al. ..... 340/872.6
6,329,903 B1 12/2001 Yamamori ..... 340/7.63
6,448,491 B1 9/2002 Sato et al.
6,677,851 B1 1/2004 Losey
6,712,989 B1 3/2004 Awakura et al. ..... 252/62.51
6,723,914 B1 4/2004 Kamei et al. ..... 174/35 R
6,812,707 B2 11/2004 Yonezawa et al. ..... 324/326
6,930,646 B2 * 8/2005 Yahata et al. ..... 343/718
6,992,952 B2 * 1/2006 Endo et al. ..... 368/10

(Continued)

FOREIGN PATENT DOCUMENTS

EP 0 443 491 A1 8/1991

(Continued)

*Primary Examiner*—Don Wong
*Assistant Examiner*—Marie Antoinette Cabucos
(74) *Attorney, Agent, or Firm*—Frishauf, Holtz, Goodman & Chick, P.C.

(57) ABSTRACT

A coil antenna having a magnetic core and a wire wound around the magnetic core. The magnetic core is flexible and bendable and is made of a mixture including soft magnetic powder and an organic binder agent. The soft magnetic powder comprises a plurality of particles, each of which is coated with an insulator layer which is made of an oxide layer.

25 Claims, 4 Drawing Sheets

U.S. PATENT DOCUMENTS

| | | | | |
|---|---|---|---|---|
| 2002/0039667 | A1 | 4/2002 | Takaya et al. | 428/692 |
| 2003/0184489 | A1* | 10/2003 | Maruyama et al. | 343/788 |
| 2004/0090868 | A1 | 5/2004 | Endo et al. | 368/10 |
| 2005/0007296 | A1 | 1/2005 | Endo et al. | 343/895 |

FOREIGN PATENT DOCUMENTS

| | | | |
|---|---|---|---|
| EP | 0 480 064 | A1 | 4/1992 |
| EP | 0 877 394 | A1 | 11/1998 |
| EP | 1 150 311 | A2 | 10/2001 |
| JP | 2001-337181 | A | 12/2001 |
| JP | 2002372591 | A * | 12/2002 |

* cited by examiner

COIL ANTENNA

BACKGROUND OF THE INVENTION

This invention relates to a coil antenna used for transmitting and/or for receiving radio signals within a low or medium frequency band. Specifically, the target frequencies of the radio signals range from 10 kHz to 5 MHz.

There have been used or proposed various kinds of apparatuses, systems, or terminals, which transmit and/or receive radio signals of low or medium frequencies. A typical, well-known system is an AM (amplitude modulation) radio system. A relatively new system is a radio controlled timepiece, especially, a radio controlled wristwatch. Other relatively new system is an immobilizer for vehicle, a remote keyless entry system for vehicle or for house, or an RFID system. For more is information about a radio controlled wristwatch, see U.S. Pat. No. 6,134,188, which is incorporated herein by reference in its entirety. For more information about a remote keyless entry system for vehicle, see U.S. Pat. No. 6,677,851, which is incorporated herein by reference in its entirety.

An important component common to the above-mentioned apparatuses or the like is an antenna, especially, a coil antenna which comprises a magnetic core and a coil wound around the magnetic core. For example, an already-existing magnetic core for coil antenna is made of a sintered ferrite core or a laminated core consisting of amorphous metal sheets. The former is easily breakable and does not have flexibility on design because of its hardness. The latter is not easily machinable and is expensive so that its manufacturing cost becomes high.

An improved coil antenna is disclosed in JP-A 2001-337181, which is incorporated herein by reference in its entirety. The disclosed coil antenna is used for a radio controlled timepiece or wristwatch and has a core comprised of powder particles or flakes of ferrite or metal and a plastic binder agent. The core may hold another harder core, such as a sintered ferrite core or a laminated core made of amorphous metal sheets. The core comprised of JP-A 2001-337181 possesses high impact resistance because of its softness and can be readily formed with low cost.

SUMMARY OF THE INVENTION

Inventors of the present invention could recognize that, in JP-A 2001-337181, there was a preconception which impeded large improvement of a coil antenna in its design flexibility. The preconception was that a core for coil antenna was not allowed to be bent flexibly.

Since there was the preconception, nobody could consider a possibility of a flexible, bendable, magnetic core for coil antenna. Accordingly, it was not considered what structure was suitable for the flexible, bendable, magnetic core.

The present invention removes the above-mentioned preconception and provides a coil antenna comprising a magnetic core which has suitable structure for being bent flexibly.

According to an aspect of the present invention, a coil antenna comprises a magnetic core and a wire wound around the magnetic core, wherein: the magnetic core is flexible and bendable and is made of a mixture comprising soft magnetic powder and an organic binder agent; and the soft magnetic powder comprises a plurality of particles each of which is coated with an insulator layer.

Because each of the power particles is coated with the insulator layer, the coil antenna according to the aspect of the present invention has a superior μ' characteristic on a frequency range of from 10 kHz to 5 MHz even if the coil antenna is bent while being used and even if the coil antenna is kept in the bent state.

An appreciation of the objectives of the present invention and a more complete understanding of its structure may be had by studying the following description of the preferred embodiment.

DESCRIPTION OF PREFERRED EMBODIMENTS

An embodiment of the present invention has two different coil antennas. One of them is for signal transmission, while the other is for signal reception. Each of the coil antennas comprises a magnetic core and a wire wound around the magnetic core. Each of the magnetic cores is made of a mixture comprising soft magnetic powder and an organic binder agent and is formed to be flexible and bendable. The soft magnetic powder comprises a plurality of particles each of which is coated with an insulator layer.

Figure 1:
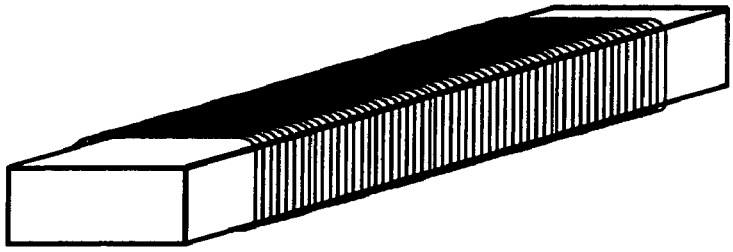
FIG. 1 is a perspective view schematically showing a coil antenna which comprises a magnetic core of a platelike shape and a wire wounded around the magnetic core.
Figure 2:
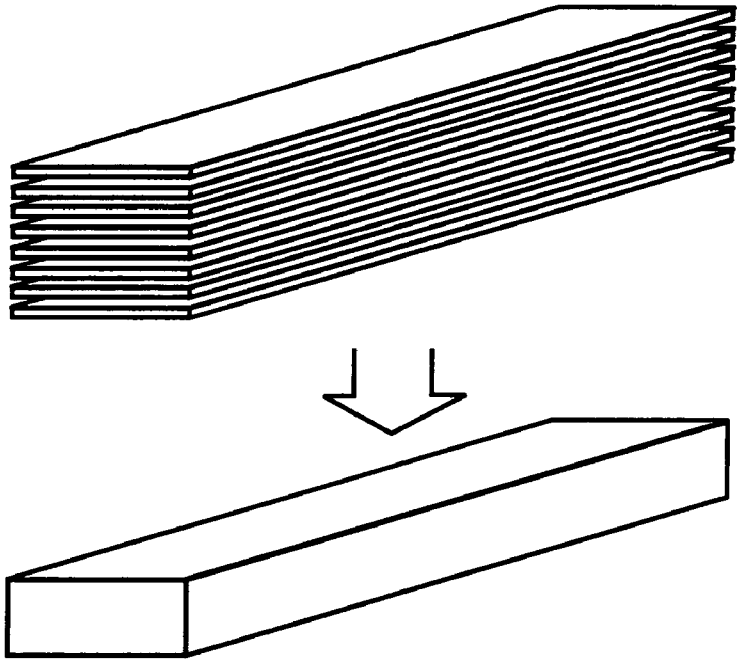
FIG. 2 is a perspective view schematically showing the magnetic core of the platelike shape which is formed by stacking a plurality of sheet-like shaped magnetic cores.
Figure 3:
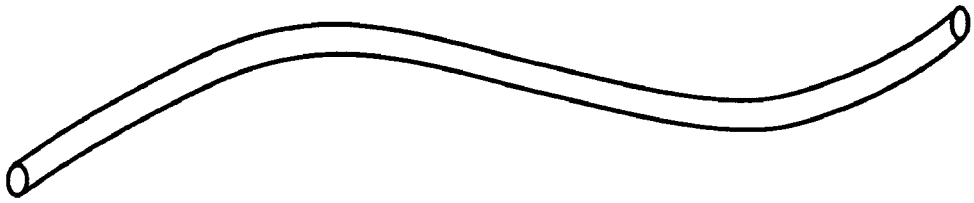
FIG. 3 is a schematic view showing a string-like shape of a magnetic core.

In this embodiment, each of the magnetic cores is formed in a plate-like shape. In detail, the magnetic core for signal transmission has a size of 8×8×60 $mm^3$, and the wire for 10 T is wound thereon. As shown in FIG. 1, the magnetic core for signal reception has a size 2×10×60 $mm^3$, and the wire for 100 T is wound thereon. Each of the wires is a polyurethane enameled copper wire. Each of the magnetic cores of the plate-like shapes is formed by stacking a plurality of sheet-like shaped magnetic cores thinner than the magnetic core of the platelike shape, as shown in FIG. 2. According to the forming method, a large press machine is not required for making a large sized magnetic core. Also, a complicated mold or die is not required for making a magnetic core of a complicated shape, because the sheet-like shaped magnetic core can be easily cut by the use of a cutter or a pair of scissors. The magnetic core may have a string-like shape, as shown in FIG. 3.

Each of the magnetic cores of the present embodiment is obtained by, under the normal atmospheric pressure, casting or molding and curing or hardening the above-mentioned mixtures of the soft magnetic powder and the organic binder agent. The compression molding and the injection molding are not required to obtain the magnetic cores of the present embodiment.

In this embodiment, the coil antenna for signal transmission and the other coil antenna for signal reception are similar to each other, except for their size and their magnetic flux density of the wires as mentioned above. Now, explanations will be made of the common matters.

The soft magnetic powder of this embodiment is Fe—Si—Al alloy powder, especially, Sendust powder, wherein Fe, Si, Al are 84%, 10%, 6%, respectively. The soft magnetic powder may be other powder. For example, the soft magnetic powder may be Fe carbonyl powder, ferrite powder, or pure iron powder. The soft magnetic powder may be powder made of Fe—Si—Al alloy, Fe—Ni alloy (Permalloy), Fe—Co alloy, Fe—Co—Si alloy, Fe—Si—V alloy, Fe—Co—B alloy, Co base amorphous metal, Fe base amorphous metal, or Mo-permalloy. Also, the soft magnetic powder may be a combination of the above-mentioned powders.

In this embodiment, the soft magnetic powder comprises flat particles. In more detail, each of the flat particles has an aspect ratio of 5 or more and its diameter is about 35 μm.

In this embodiment, the insulator layer is made of non-magnetic material, especially, an oxide film. The oxide film of this embodiment is formed in an annealing process for the soft magnetic powder. The oxide film may be obtained by another means or way. The insulator layer may be made of an organic binder agent.

The organic binder agent of the present embodiment is chlorinated polyethylene. A titanate coupler is added to the organic binder in this embodiment. Alternatively, a silane coupler or an aluminate coupler may be used. Also, no coupler may be used.

The organic binder agent may be made of another elastomer agent. For example, the organic binder agent may be thermoplastic resin, such as resin made of polyester resin, polyvinyl chloride resin, chlorinated polyethylene, polyvinyl butyral resin, polyurethane resin, cellulosic resin, polyvinyl acetate resin, phenoxy resin, polypropylene, polycarbonate resin, ABS (acrylontrile-butadiene-styrene copolymer) resin, polyvinyl alcohol resin, polyimide resin, polyethylene resin, polyamide resin, polyacrylic ester resin, or polyacrylonitrile resin, or copolymer thereof. The organic binder agent may be thermosettable resin, such as resin made of epoxy resin, phenol resin, amide resin, imide resin, diallyl phthalate resin, unsaturated polyester resin, melamine resin, urea resin, or silicone resin, or a combination thereof. Alternatively, the organic binder agent may be synthetic rubber, such as nitrile-butadiene rubber, styrene-butadiene rubber or a combination thereof. Furthermore, the organic binder agent is a plastomer agent, provided that it can provide a flexible, bendable, magnetic core. Another coupling agent can be added to the organic binder.

In this embodiment, the mixing ratio of the soft magnetic power is 80 wt %, and the total mixing ratio of the organic binder agent and the coupler is 20 wt %. The mixing ratio of the soft magnetic powder in the mixture may be in a range of from 60 wt % to 95 wt %, both inclusive. The mixing ratio of the organic binder in the mixture may be in a range of from 5 wt % to 40 wt %, both inclusive. If a coupler added thereto, the mixing ratio of the coupler in the mixture is 5 wt % or less.

The mixture may further comprise an organic flame retardant, such as an organic flame retardant made of halogenide, bromide polymer or a combination thereof.

To evaluate the coil antennas for signal transmission and for signal reception in accordance with the present embodiment, the above-mentioned coil antennas were formed, and their characteristics were measured. As comparative examples, two coil antennas were formed of sintered ferrite cores and wires wound thereon; one of the comparative coil antenna was for signal transmission, while the other was for signal reception. The comparative coil antennas had the same structures, shapes, sizes as those of the embodiment except for the materials of the magnetic cores. The characteristics of the comparative coil antennas were also measured. The measured results are as follows.

Each of the magnetic cores of the present embodiment had rubber hardness degree of 60 or more, which was measured by using type-A durometer in accordance with JIS K 6253. JIS is an abbreviation of "Japan Industrial Standard", and JIS K 6253 is entitled "Hardness testing methods for rubber, vulcanized or thermoplastic". The magnetic core of the present embodiment had a tensile strength of 3.8 MPa, which was measured in accordance with JIS K 6263. The JIS K 6263 is entitled "Rubber, vulcanized or thermoplastics—Determination of stress relaxation".

The coil antenna for signal transmission and the coil antenna for signal reception had superior transmission and reception characteristics in comparison with the comparative coil antenna for signal transmission and the comparative coil antenna for signal reception.

In addition, the superior transmission and reception characteristics were kept even when the coil antennas were bent. This is because the particles of the magnetic powder are separated from and independent of each other and work as "micro-cores", respectively. The number of the micro-cores does not change even when the coil antenna is bent because each of the particles is coated with the oxide film.

Figure 4:
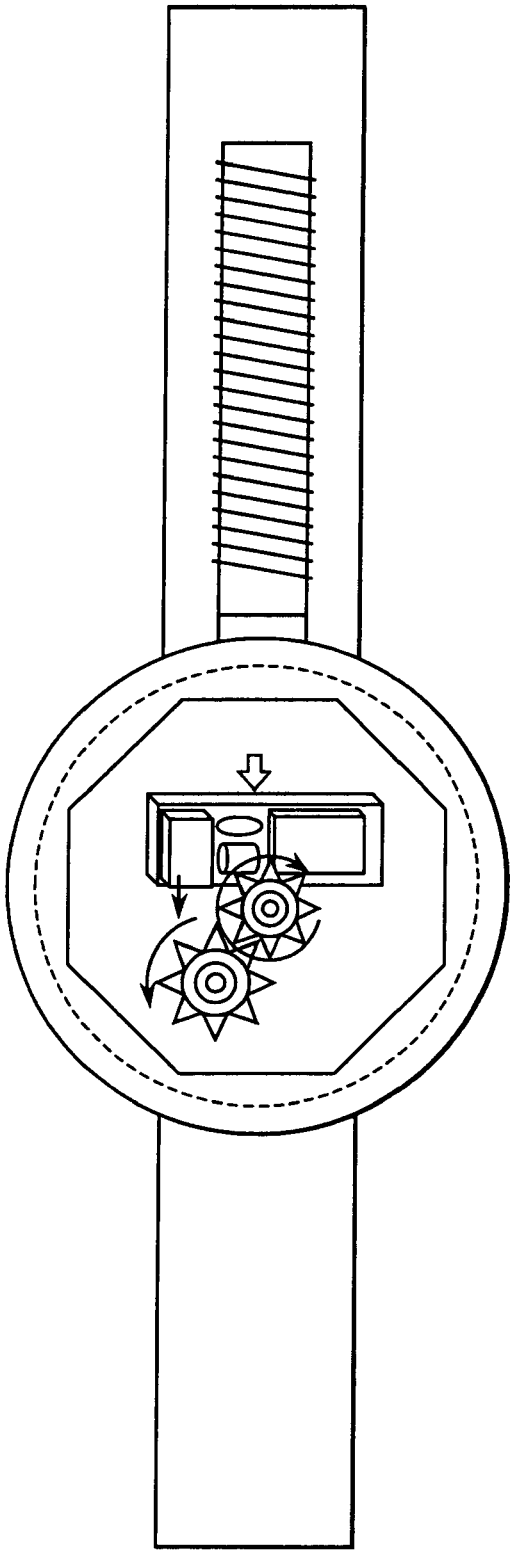
FIG. 4 is a schematic view showing a radio controlled wristwatch, which comprises a coil antenna and a mechanism for automatically adjusting a time in accordance with radio signals received by using the coil antenna, wherein the radio controlled wristwatch comprises a case and a watchband depending therefrom, and the coil antenna is embedded in the watchband.
Figure 5:
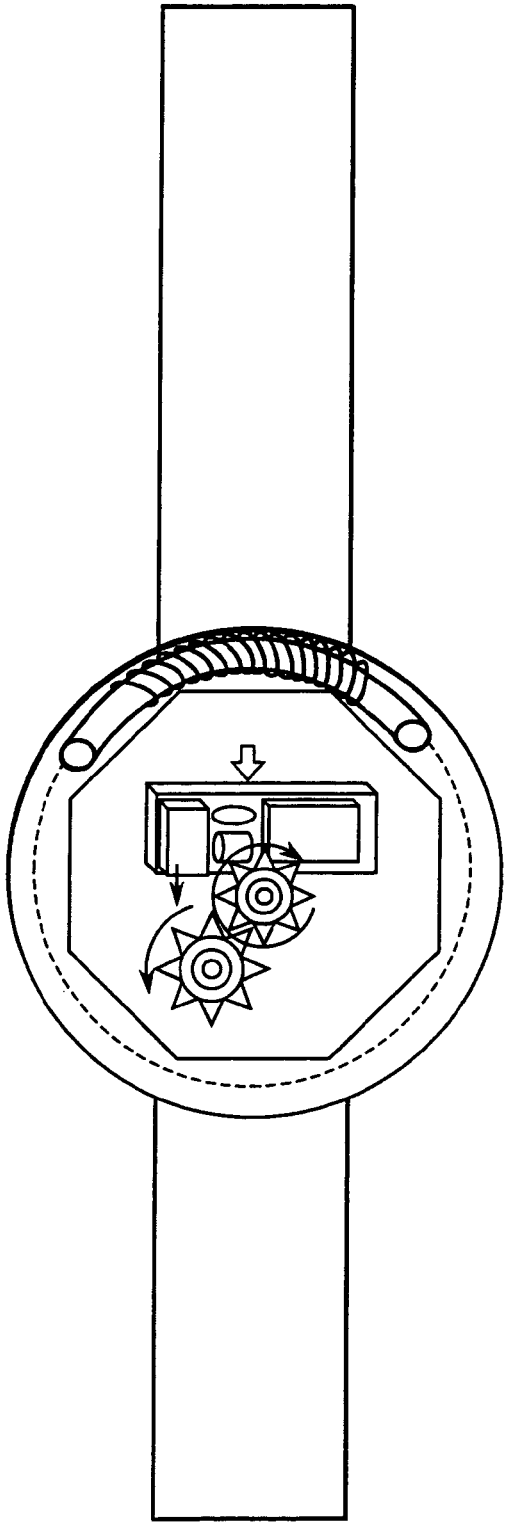
FIG. 5 is a schematic view showing a radio controlled wristwatch, which comprises a coil antenna and a mechanism for automatically adjusting a time in accordance with radio signals received by using the coil antenna, wherein the radio controlled wristwatch comprises a case and a watchband depending therefrom, and the magnetic core is curved within a plane parallel to the bottom plane of the case and extends along an inside of the peripheral wall of the case.
Figure 6:
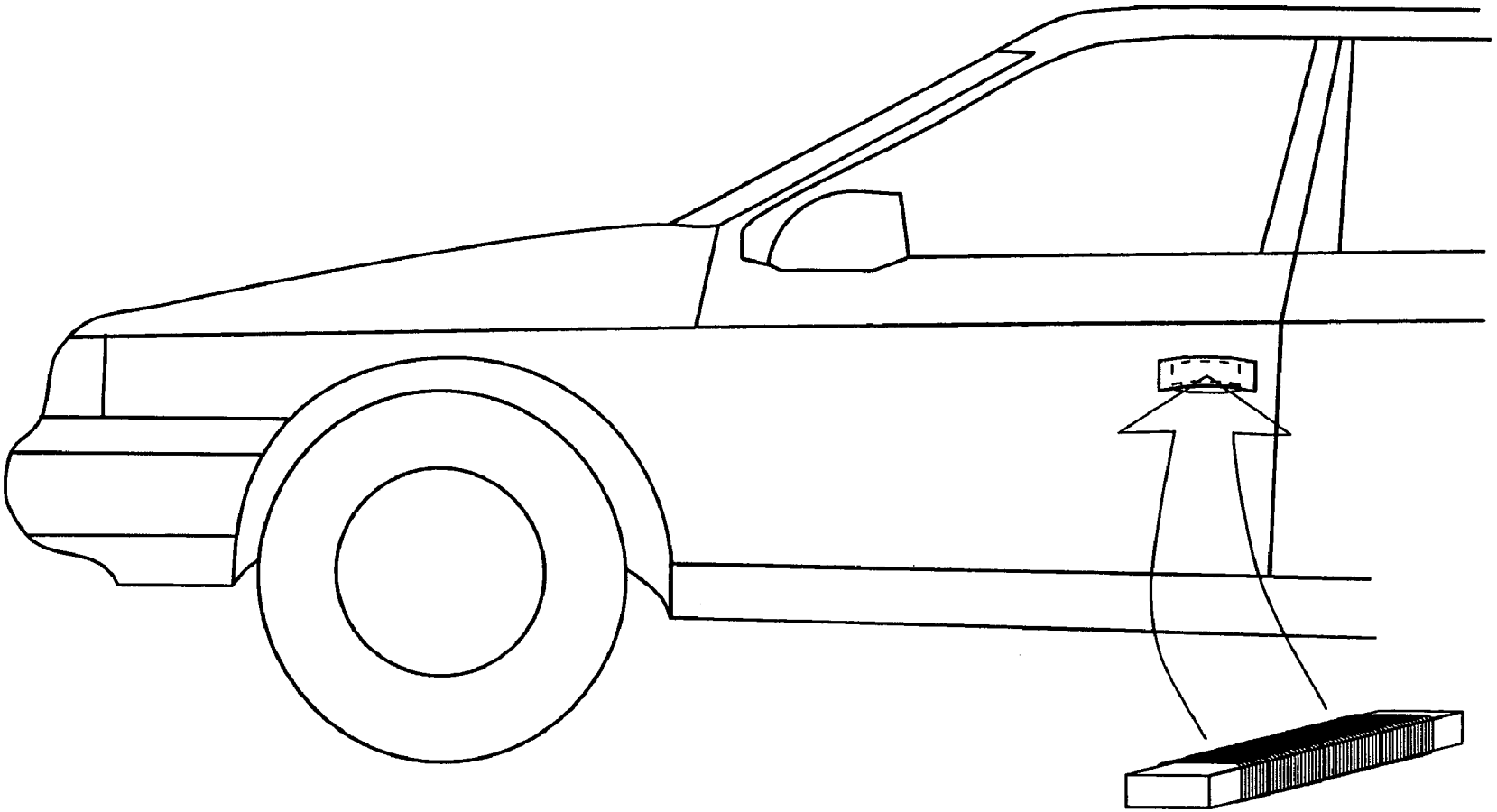
FIG. 6 is a schematic view showing a vehicle which includes a remote keyless entry system, wherein the coil antenna is for receiving user identification signals transmitted from an object carried by a user, and the coil antenna is contained in a door handle of the vehicle.

The above-mentioned coil antenna is applicable to a radio transmitting/receiving system for transmitting or receiving radio signals ranging from 10 kHz to 5 MHz. For example, the above-mentioned coil antenna is applicable to a radio controlled wristwatch, which further comprises a mechanism for automatically adjusting a time in accordance with radio signals received by using the coil antenna. Specifically, the radio controlled wristwatch comprises a case and a watchband depending therefrom. The coil antenna may be embedded in the watchband, as shown in FIG. 4. Alternatively, the magnetic core may be curved within a plane parallel to the bottom plane of the case and extends along an inside of the peripheral wall of the case, as shown in FIG. 5. Furthermore, the coil antenna of the present embodiment is applicable to a remote keyless entry system, wherein the coil antenna is for receiving user identification signals, which are transmitted from an object carried by a user. In a case where a vehicle adopts the remote keyless entry system, the coil antenna may be embedded within the vehicle. More specifically, the coil antenna may be contained in a door handle of the vehicle, as shown in FIG. 6.

The preferred embodiments of the present invention will be better understood by those skilled in the art by reference to the above description and figures. The description and preferred embodiments of this invention illustrated in the figures are not to intend to be exhaustive or to limit the invention to the precise form disclosed. They are chosen to describe or to best explain the principles of the invention and its applicable and practical use to thereby enable others skilled in the art to best utilize the invention.

While there has been described what is believed to be the preferred embodiment of the invention, those skilled in the art will recognize that other and further modifications may be made thereto without departing from the sprit of the invention, and it is intended to claim all such embodiments that fall within the true scope of the invention.

This application is based on Japanese Patent Application filed on Jul. 2, 2003, No. 2003-270331, and those claims, specification and drawings are incorporated herein by reference.

What is claimed is:

1. A coil antenna comprising a magnetic core and a wire wound around the magnetic core, wherein the magnetic core is flexible and bendable and is made of a mixture comprising soft magnetic powder and an organic binder agent, the soft magnetic powder comprising a plurality of particles, each of said particles being coated with an insulator layer, said insulation layer being made of an oxide film.

2. The coil antenna accordingto claim 1, wherein the magnetic core has a platelike shape, a sheet-like shape, or a stringlike shape.

3. The coil antenna according to claim 1, wherein the magnetic core is obtainable by, under normal atmospheric pressure, casting or molding and curing or hardening the mixture.

4. The coil antenna according to claim 1, wherein the organic binder agent is a plastomer agent.

5. The coil antenna according to claim 1, wherein the organic binder agent is an elastomer agent.

6. The coil antenna according to claim 5, wherein the organic binder agent is a thermoplastic resin.

7. The coil antenna according to claim 6, wherein the organic binder agent is made of polyester resin, polyvinyl chloride resin, chlorinated polyethylene, polyvinyl butyral resin, polyurethane resin, cellulosic resin, polyvinyl acetate resin, phenoxy resin, polypropylene, polycarbonate resin, acrylonitrile-butadiene-styrene copolymer resin, polyvinyl alcohol resin, polyimide resin, polyethylene resin, polyamide resin, polyacrylic ester resin or polyacrylonitrile resin, or a copolymer thereof.

8. The coil antenna according to claim 5, wherein the organic binder agent is a thermosettable resin.

9. The coil antenna according to claim 8, wherein the organic binder agent is made of epoxy resin, phenol resin, amide resin, imide resin, diallyl phthalate resin, unsaturated polyester resin, melamine resin, urea resin, or silicone resin, or a combination thereof.

10. The coil antenna according to claim 5, wherein the organic binder agent is synthetic rubber.

11. The coil antenna according to claim 10, wherein the organic binder agent is made of nitrile-butadiene rubber, styrene-butadiene rubber or a combination thereof.

12. The coil antenna according to claim 1, wherein the soft magnetic powder is Fe carbonyl powder, ferrite powder, pure iron powder, or powder made of Fe—Si—Al alloy, Fe—Ni alloy, Fe—Co alloy, Fe—Co—Si alloy, Fe—Si—V alloy, Fe—Co—B alloy, Co base amorphous metal, Fe base amorphous metal, or Mo—permalloy, or a combination thereof.

13. The coil antenna according to claim 1, wherein the organic binder is contained in the mixture in an amount of 5 percent by weight to 40 percent by weight.

14. The coil antenna according to claim 1, wherein the mixture further comprises an organic flame retardant.

15. The coil antenna according to claim 14, wherein the organic flame retardant is made of halogenide, bromide polymer or a combination thereof.

16. The coil antenna according to claim 1, wherein the soft magnetic powder comprises a plurality of flat particles.

17. The coil antenna according to claim 16, wherein each of the flat particles has an aspect ratio of 5 or more.

18. In a radio transmitting/receiving system for transmitting or receiving radio signals ranging from 10 kHz to 5 MHz which comprises a coil antenna to transmit or receive the radio signals, wherein the improvement comprising the coil antenna comprising a magnetic core and a wire wound around the magnetic core, the magnetic core being flexible and bendable and being made of a mixture comprising soft magnetic powder and an organic binder agent, the soft magnetic powder comprises a plurality of particles, each of said particles being coated with an insulator layer, said insulator layer being made of an oxide layer.

19. In a radio controlled wristwatch comprising: a coil antenna and a mechanism for automatically adjusting a time in accordance with radio signals received by the coil antenna, wherein the improvement comprising the coil antenna comprising a magnetic core and a wire wound around the magnetic core, the magnetic core being flexible and bendable and being made of a mixture comprising soft magnetic powder and an organic binder agent, the soft magnetic powder comprising a plurality of particles, each of said particles being coated with an insulator layer, said insulator layer being made of an oxide layer.

20. The radio controlled wristwatch according to claim 19, further comprising a case and a watchband depending therefrom, wherein the coil antenna is provided in the watchband.

21. The radio controlled wristwatch according to claim 19, further comprising a case and a watchband depending therefrom, wherein the case comprises a bottom plane and a peripheral wall; and the magnetic core is curved within a plane parallel to the bottom plane and extends along an inside of the peripheral wall.

22. In a remote keyless entry system comprising a coil antenna, wherein the coil antenna is for receiving user identification signals, the identification signals being transmitted from an object carried by a user, wherein the improvement comprising the coil antenna comprising a magnetic core and a wire wound around the magnetic core, the magnetic core being flexible and bendable and being made of a mixture comprising soft magnetic powder and an organic binder agent, the soft magnetic powder comprising a plurality of particles, each of said particles being coated with an insulator layer, said insulator layer being made of an oxide layer.

23. In a vehicle comprising a remote keyless entry system comprising a coil antenna, the improvement comprising the coil antenna comprising a magnetic core and a wire wound around the magnetic core, the magnetic core being flexible and bendable, the soft magnetic powder comprising a plurality of particles, each of said particles being coated with an insulator layer, said insulator layer being made of an oxide layer, wherein the coil antenna is embedded within the vehicle.

24. The vehicle according to claim 23, wherein the coil antenna is contained in a door handle of the vehicle.

25. The coil antenna according to claim 1, wherein the organic binder is contained in the mixture in an amount of 60 weight percent to 95 weight percent.

* * * * *